US006280254B1

(12) United States Patent
Wu et al.

(10) Patent No.: US 6,280,254 B1
(45) Date of Patent: Aug. 28, 2001

(54) IC CARD CONNECTOR

(75) Inventors: Kun-Tsan Wu; Yu-Chen Chen; Chien Cheng Chen, all of Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/510,109

(22) Filed: Feb. 22, 2000

(30) Foreign Application Priority Data

Dec. 23, 1999 (TW) ..... 88122817

(51) Int. Cl.[7] ..... H01R 24/00
(52) U.S. Cl. ..... 439/630; 439/66; 439/515
(58) Field of Search ..... 439/630, 66, 515, 439/862

(56) References Cited

U.S. PATENT DOCUMENTS 4,362,353 * 12/1982 Cobaugh et al. ..... 439/515
4,647,124 * 3/1987 Kandybowski ..... 439/515
5,879,169 * 3/1999 Wu ..... 439/66
5,980,323 * 11/1999 Bricaud et al. ..... 439/630
5,984,693 * 11/1999 McHugh et al. ..... 439/515
6,019,611 * 2/2000 McHugh et al. ..... 439/515
6,027,345 * 3/1999 McHugh et al. ..... 439/66

* cited by examiner

*Primary Examiner*—Gary F. Paumen
(74) *Attorney, Agent, or Firm*—Wei Te Chung

(57) ABSTRACT

An IC card connector comprises an insulative housing and a plurality of contacts. A plurality of passageways is defined through the insulative housing for receiving the corresponding contacts therein. Each contact comprises a first contacting arm, a second contacting arm and a retaining portion connected between the first and second contacting arms. The first contacting arm comprises a first arcuate portion for electrically a contacting corresponding circuit of an IC card and a first connecting portion connected between the first arcuate portion and the retaining portion. The second contacting arm comprises a second arcuate portion, a soldering portion downwardly extending from the second arcuate portion, a second connecting portion extending from the retaining portion to the soldering portion, and a pair of fixing portions extending from lateral edges of the second connecting portion. In operation, after the IC card is inserted into the IC connector, the first arcuate portion is downwardly pressed to contact the second arcuate portion. The contact forms a parallel electrical connection between the IC card and the circuit board. Thus the signal transmission path is shortened and the electrical resistance of the contact in the present IC card connector is decreased.

1 Claim, 6 Drawing Sheets

IC CARD CONNECTOR

BACKGROUND OF THE INVENTION

The present invention relates to an IC card connector, and particularly to an IC card connector providing electrical contact with low electrical resistance for electrically connecting an IC card with a circuit board.

A conventional IC card connector is disclosed in U.S. Pat. No. 5,879,169 and Taiwan Patent Application No. 86212723. Referring to FIG. 1, a conventional IC card connector 4 comprises an insulative housing 40 and a plurality of terminals 41. Each terminal 41 comprises a contacting portion 410 for electrically contacting an inserted IC card (not shown) and a soldering portion 412 for soldering onto a circuit board 5. The IC card connector 4 is connected between the IC card and the circuit board 5 for signal transmission therebetween. The contacting portion 410 has an arcuate profile for improving the resilience of the terminal 41 and for providing a reliable connection with the inserted IC card.

Typically, when making a resilient terminal 41, the terminal 41 is folded to provide an arcuate profile with significant length. The increased length equates to an electrical path having increased resistance between the IC card and the circuit board 5.

Thus an improved IC card connector is required to provide a low resistance between the IC card and the circuit board.

BRIEF SUMMARY OF THE INVENTION

A main object of the present invention is to provide an IC card connector for providing an electrical connection between an IC card and a circuit board which has low electrical resistance.

To fulfill the above-mentioned object, an IC card connector in accordance with the present invention comprises an insulative housing and a plurality of contacts. A plurality of passageways is defined through the insulative housing for receiving the corresponding contacts therein. Each contact comprises a first contacting arm, a second contacting arm and a retaining portion connecting the first and second contacting arms. The first contacting arm comprises a first arcuate portion for electrically contacting corresponding circuit of an IC card and a first connecting portion connected between the first arcuate portion and the retaining portion. The second contacting arm comprises a second arcuate portion, a soldering portion downwardly extending from the second arcuate portion, a second connecting portion extended from the retaining portion to the soldering portion, and a pair of fixing portions extended from lateral edges of the second connecting portion. The retaining portion forms a plurality of barbs at lateral edges thereof.

In operation, after the IC card is inserted into the present connector, the first arcuate portion is downwardly pressed to electrically contact the second arcuate portion. The contact forms a parallel electrical connection between the IC card and the circuit board. Thus the signal transmission path is shortened and the resistance of the contacts in the present IC card connector is decreased.

Other objects, advantages and novel features of the invention will become more apparent from the following detailed description when taken in conjunction with the accompanying drawings.

DETAILED DESCRIPTION OF THE INVENTION

Figure 1:
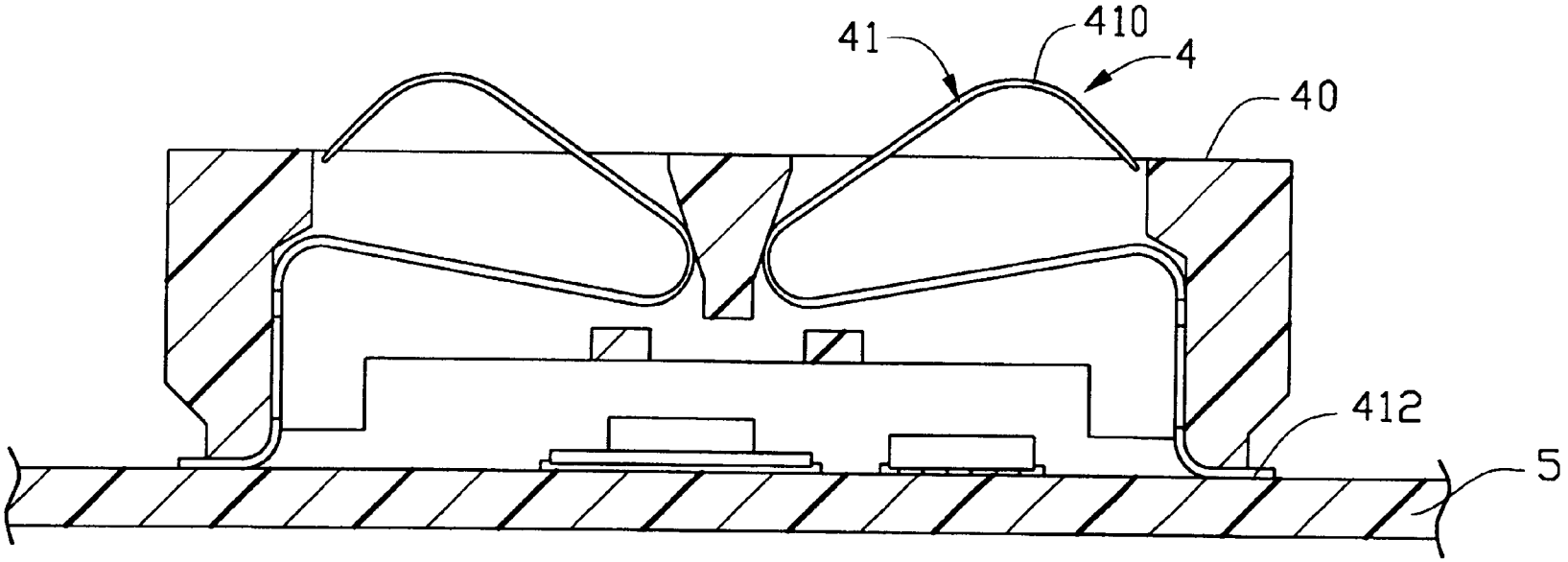
FIG. 1 (PRIOR ART)
FIG. 1 is a cross-sectional view of a conventional IC card connector.
Figure 2:
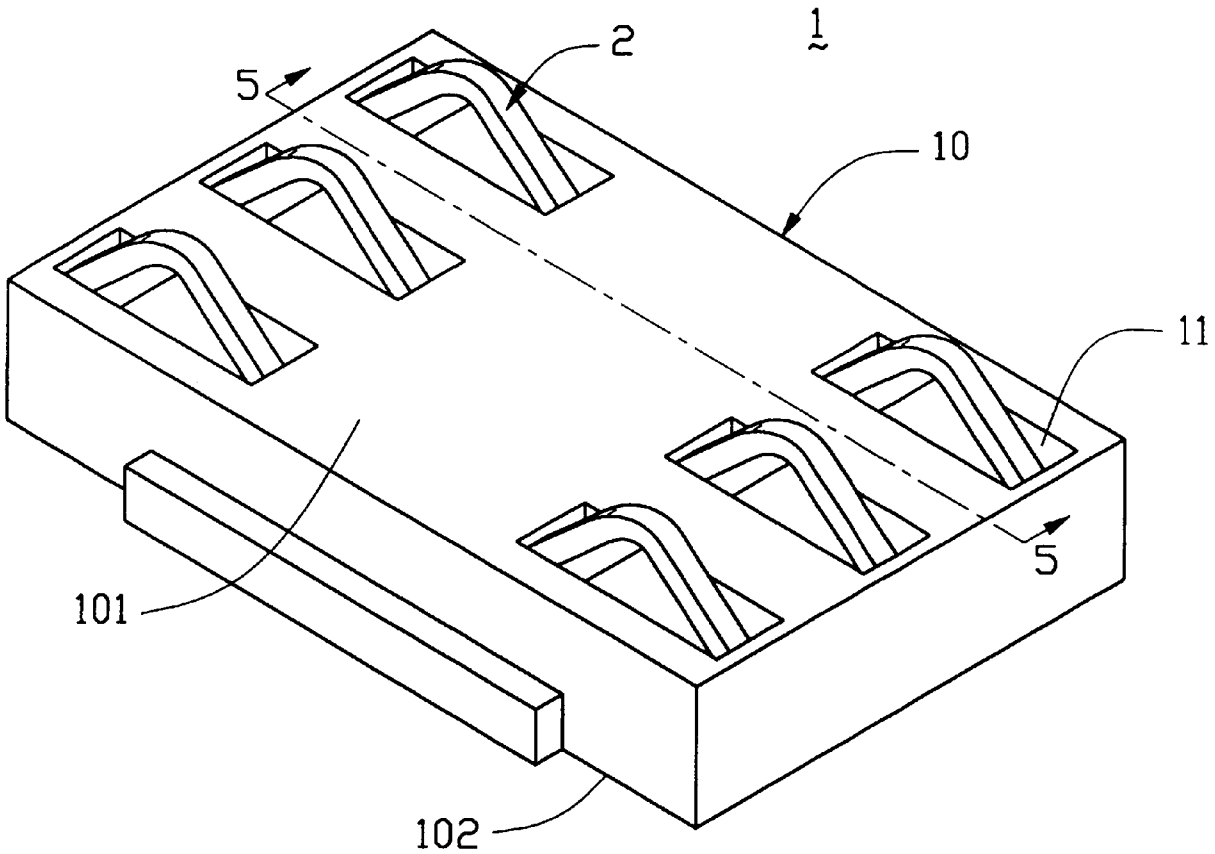
FIG. 2 is a perspective view of an IC card connector in accordance with the present invention.
Figure 3:
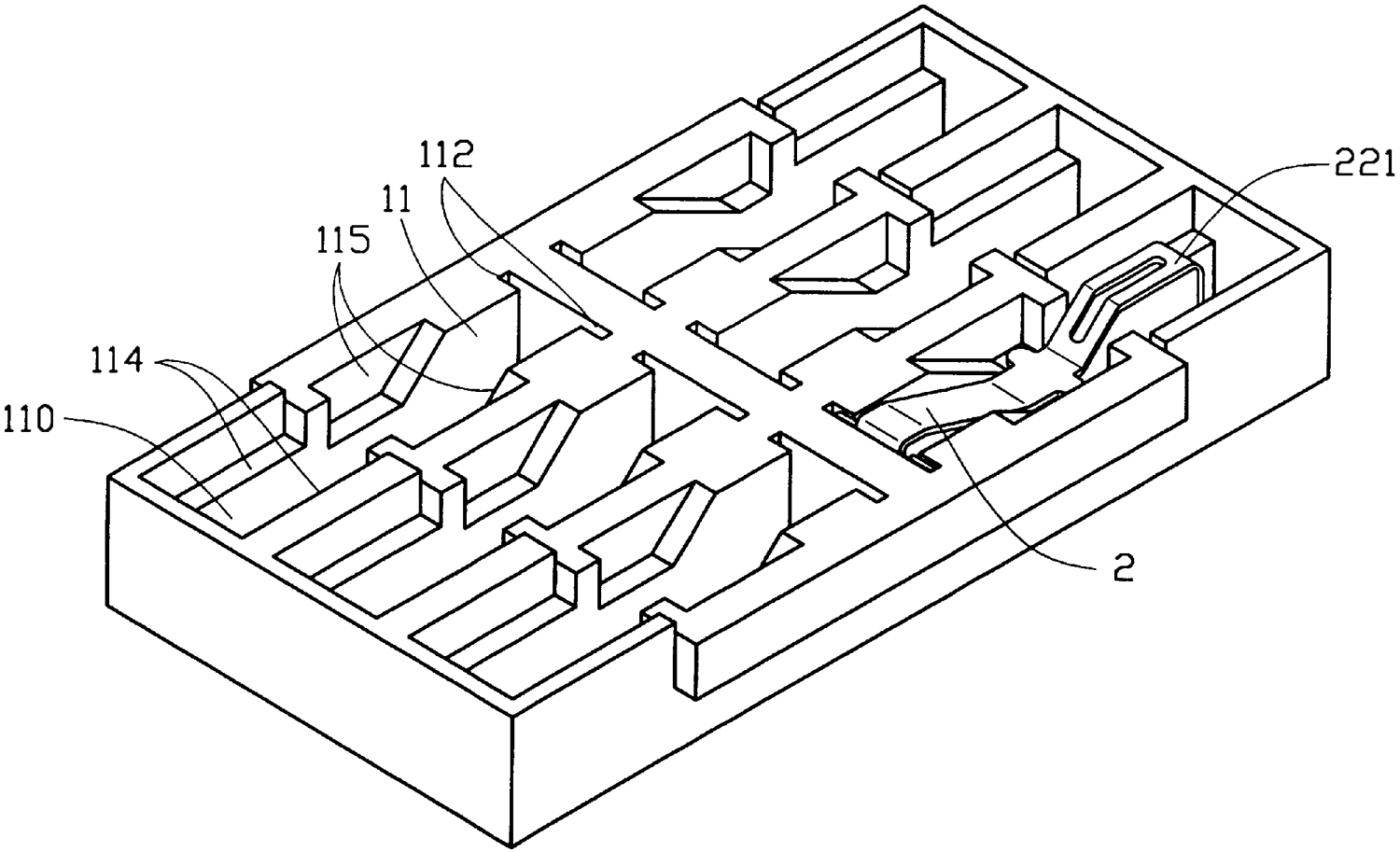
FIG. 3 is an enlarged view of the connector of FIG. 2 from a bottom aspect.

Referring to FIGS. 2 and 3, an IC card connector 1 comprises an insulative housing 10 and a plurality of contacts 2. The insulative housing 10 defines a top surface 101 and a bottom surface 102. A plurality of passageways 11 is respectively defined through the top and bottom surfaces 101, 102 for receiving the corresponding contacts 2 therein. Each passageway 11 defines a central slot 110, a pair of receiving slots 112 disposed at an end of the central slot 110, a pair of first recessed portions 114 disposed at an opposite end of the central slot 110, and a pair of second recessed portions 115 disposed on opposite sides of middle central slot.

Figure 4:
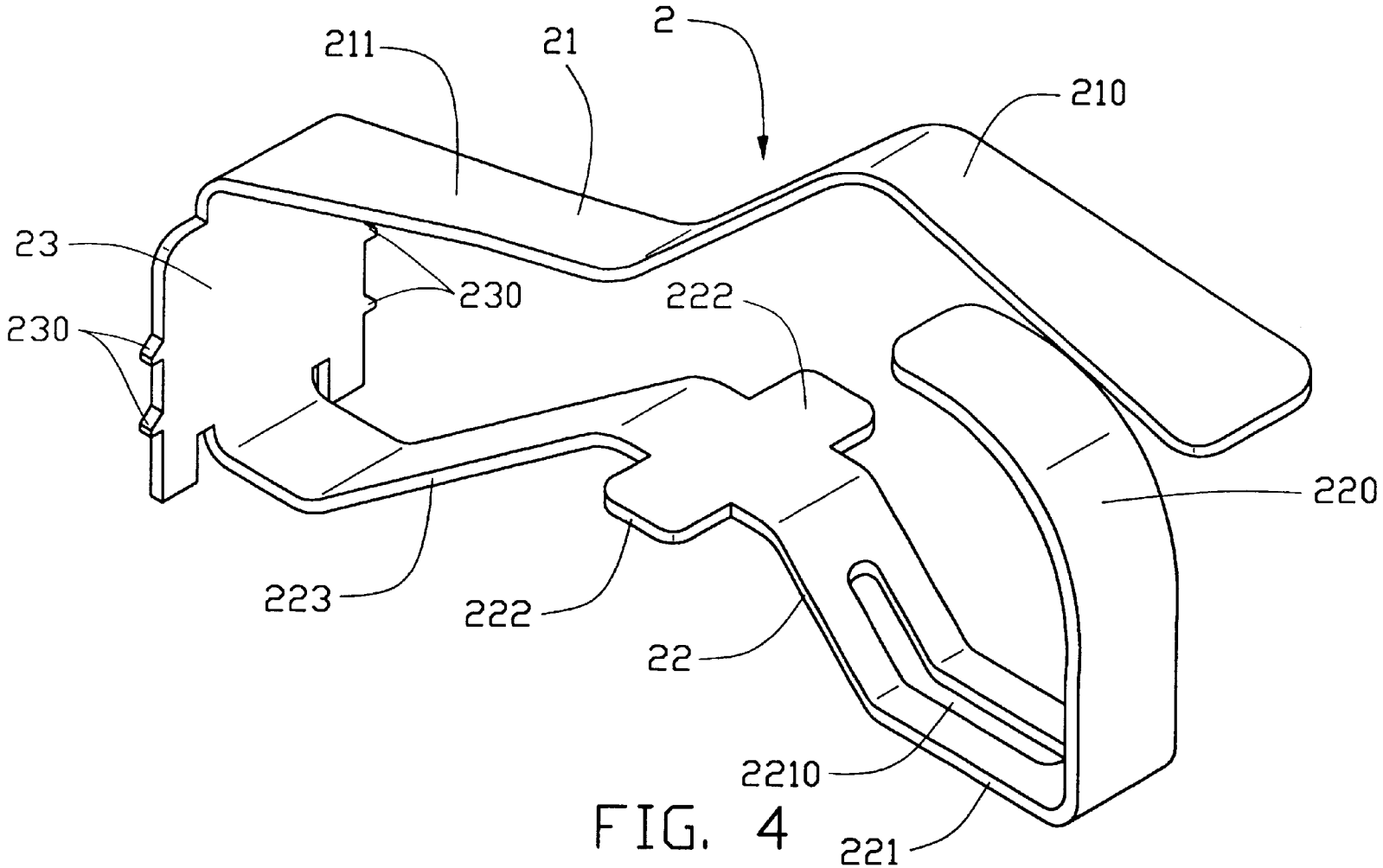
FIG. 4 is an enlarged, perspective view of a contact of the IC card connector of FIG. 2.

Referring to FIG. 4, each contact 2 comprises a first contacting arm 21, a second contacting arm 22 and a retaining portion 23 connected between the first and second contacting arms 21, 22. The first contacting arm 21 comprises a first arcuate portion 210 for electrically contacting corresponding circuit of an IC card (not shown) and a first connecting portion 211 connected between the first arcuate portion 210 and the retaining portion 23. The second contacting arm 22 comprises a second arcuate portion 220, a soldering portion 221 downwardly extending from the second arcuate portion 220, a second connecting portion 223 interconnected the retaining portion 23 to the soldering portion 221 and the soldering portion 221, and a pair of fixing portions 222 extending from lateral edges of the second connecting portion 223. The retaining portion 23 forms a plurality of barbs 230 at lateral edges thereof for securing in the receiving slots 112 of the insulative housing 10.

Figure 5:
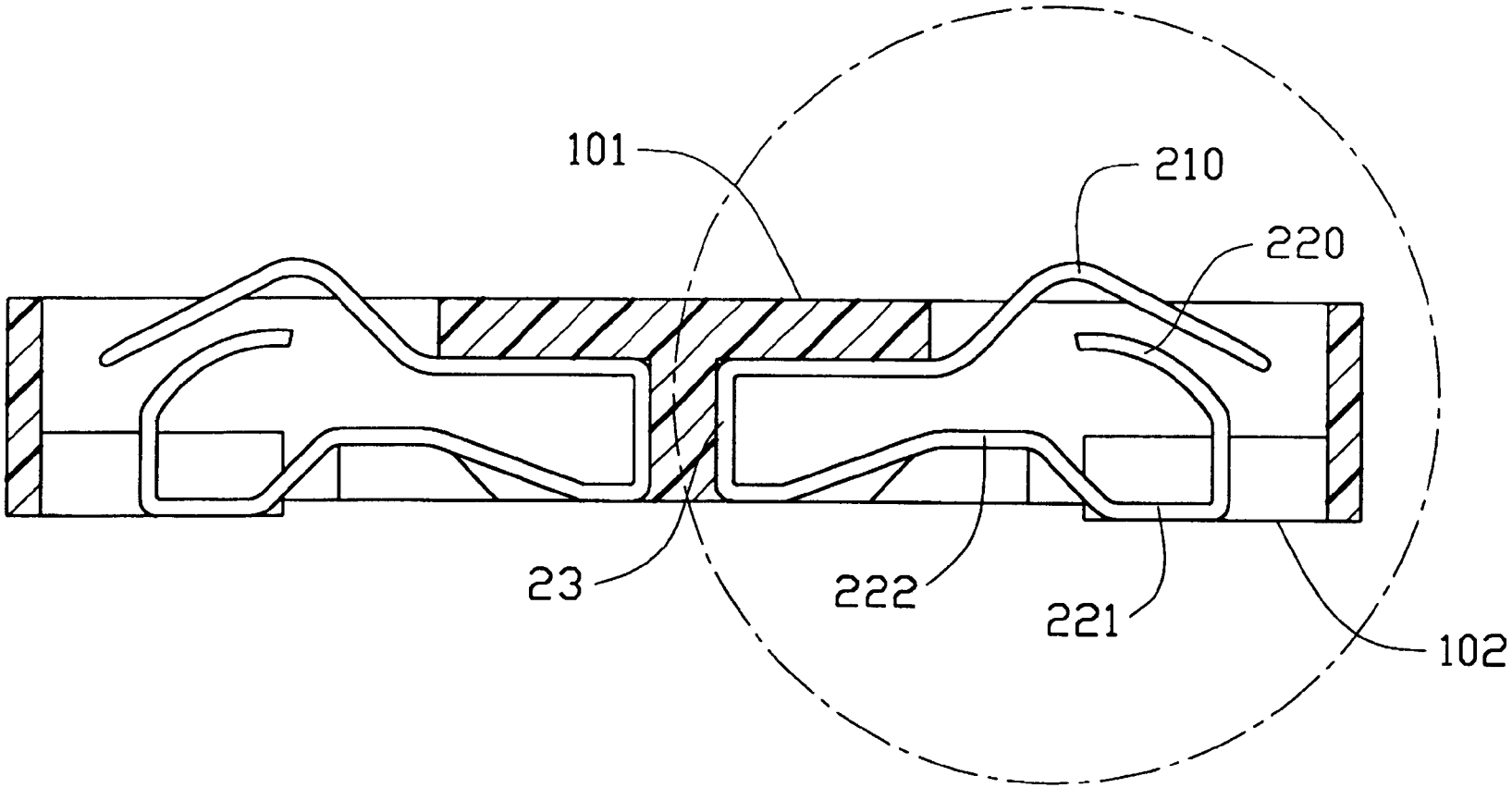
FIG. 5 is a cross-sectional view taken along line 5—5 of FIG. 2.
Figure 6:
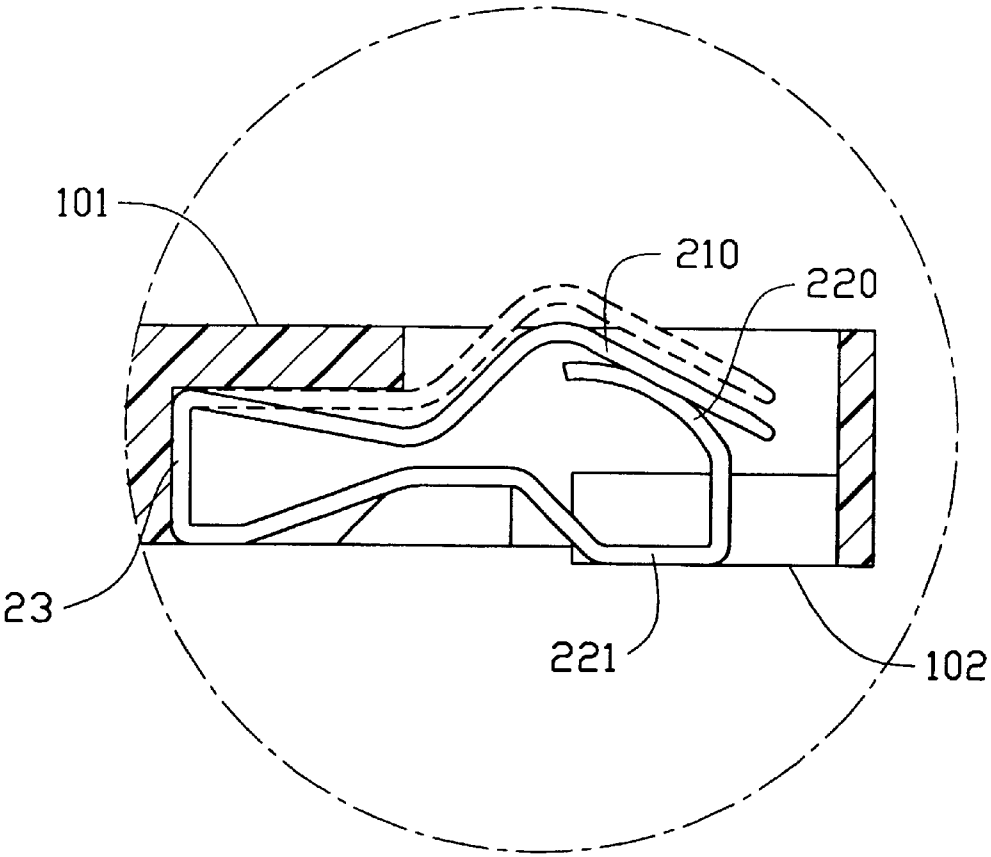
FIG. 6 is an enlarged view taken from FIG. 5.

Further referring to FIGS. 5 and 6, in assembly, the fixing portion 222 of each contact 2 is secured in a corresponding pair of second recessed portions 115 and the retaining portion 23 is secured in a corresponding pair of receiving slots 112. Thus, the contacts 2 are respectively secured in corresponding passageways 11. Each first arcuate portion 210 extends out from the top surface 101 for electrically contacting an inserted IC card. Each soldering portion 221 downwardly extends out from the bottom surface 102 for soldering onto a circuit board. A slit 2210 is defined in the soldering portion 221 of each contact 2 for receiving soldering flux and providing a reliable connection with the circuit board.

In operation, after the IC card is inserted into the present connector, the first arcuate portion 210 of each contact 2 is downwardly pressed to electrically contact the second arcuate portion 220. Thus each contact 2 forms a parallel electrical connection between the IC card and the circuit board. Compared to the signal path in the conventional invention, the signal transmission path of the present invention is shortened and the electrical resistance is decreased.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An IC card connector for electrically connecting an IC card to a circuit board, comprising:

an insulative housing defining a plurality of passageways therein; and a plurality of contacts received in the passageways, each contact comprising a first contacting arm, a second contacting arm and a retaining portion connected between the first contacting arm and the second contacting arm, the second contacting arm downwardly extending from a lower edge of the retaining portion and comprising a second arcuate portion and a soldering portion for soldering onto the circuit board, the first contacting arm upwardly extending from an upper edge of the retaining portion and defining a first arcuate portion for electrically connecting with an inserted IC card, the first arcuate portion being moved by the inserted IC card to contact the second arcuate portion, thereby forming a parallel electrical connection between the IC card and the circuit board;

wherein the second contacting arm comprises a second connecting portion extending from the retaining portion to the soldering portion, and a pair of fixing portions extending from lateral edges of the second connecting portion;

wherein the soldering portion downwardly extends from the second arcuate portion for soldering onto the circuit board;

wherein a slit is formed in the soldering portion for receiving soldering flux to effectuate a reliable connection with the circuit board;

wherein the retaining portion forms a plurality of barbs at lateral edges thereof for securing in the insulative housing.

* * * * *